United States Patent [19]

Wittmann et al.

[11] Patent Number: 5,076,604

[45] Date of Patent: Dec. 31, 1991

[54] APPARATUS FOR MOUNTING SKI BINDINGS

[75] Inventors: Heinz Wittmann, Vienna; Roland Erdei, Weigelsdorf, both of Austria

[73] Assignee: TMC Corporation, Baar, Switzerland

[21] Appl. No.: 469,592

[22] PCT Filed: Jul. 10, 1989

[86] PCT No.: PCT/EP89/00795

§ 371 Date: Mar. 23, 1990

§ 102(e) Date: Mar. 23, 1990

[87] PCT Pub. No.: WO90/00917

PCT Pub. Date: Feb. 8, 1990

[30] Foreign Application Priority Data

Jul. 25, 1988 [AT] Austria ..... A1895/88

[51] Int. Cl.[5] ..... A63C 9/00

[52] U.S. Cl. ..... 280/633

[58] Field of Search ..... 403/348, 353; 280/623, 280/633, 607, 617, 618, 634

[56] References Cited

U.S. PATENT DOCUMENTS

| | | | |
|---|---|---|---|
| 3,977,688 | 8/1976 | Imagawa | 280/633 |
| 4,035,097 | 7/1977 | Bachand | 403/348 |
| 4,129,395 | 12/1978 | Theurer et al. | 403/353 X |
| 4,524,990 | 6/1985 | Svoboda et al. | 280/633 |

FOREIGN PATENT DOCUMENTS

| | | |
|---|---|---|
| 288929 | 7/1970 | Austria . |
| 2102757 | 7/1971 | Fed. Rep. of Germany . |
| 2359489 | 6/1974 | Fed. Rep. of Germany . |
| 2613387 | 10/1977 | Fed. Rep. of Germany . |
| 2806403 | 8/1978 | Fed. Rep. of Germany . |
| 810088 | 3/1937 | France . |
| 2431868 | 2/1980 | France . |
| 2050549 | 1/1981 | United Kingdom . |

*Primary Examiner*—Andres Kashnikow
*Assistant Examiner*—Michael Mar
*Attorney, Agent, or Firm*—Flynn, Thiel, Boutell & Tanis

[57] ABSTRACT

An apparatus for facilitating a mounting of ski bindings onto skis. The apparatus includes a plate and a jaw member fastened to the plate. The plate is releasably fastened by fastening elements to the upper side of a ski. Two or more receiving parts are provided for receiving the ends of the fastening elements, which ends are on a side of the plate which is remote from the ski binding, the receiving parts being built into the body of the ski. Each receiving part includes an elliptic slotted hole or an elongated T-shaped recess, each being provided with at least one undercut step. Each fastening element is arranged on the jaw member or the plate and has a locking member at an end region thereof remote from the jaw member or the plate. The locking member has a larger dimension in one direction compared with the recess or the slotted hole of the individual receiving parts, and engages the undercut step. At least one of the fastening elements is rotatable for facilitating a movement of the larger dimensioned portion of the locking member thereof between a first position aligned with a major axis of the elliptic slotted hole or the elongated T-shaped recess extending parallel to a longitudinal axis of the ski and a second position transverse with respect to the first position and under the undercut step to thereby facilitate all of the locking members being brought into engagement with the undercut steps. The elongation of the hole and the recess facilitates a selective positioning of the plate and the jaw member fastened to the plate relative to the ski in a direction parallel to the major axes and before the locking members effect a locking of the plate to the ski at a selected position. In addition, the locking members are capable of effecting the locking of the plate at any position along the length of the elongation.

8 Claims, 7 Drawing Sheets

APPARATUS FOR MOUNTING SKI BINDINGS

FIELD OF THE INVENTION

The invention relates to an apparatus for mounting of ski bindings onto skis.

BACKGROUND OF THE INVENTION

Various apparatus of this type have already been suggested. However, none of them have proven to be successful. For example, the apparatus according to German OS 26 13 387 has the disadvantage that the fastening elements for the plate carrying the jaw member are arranged on the upper side of the ski and can thus be easily damaged when the jaw member or rather the ski binding is removed.

The introduction of Austrian Patent 288 929 states that it has already been suggested to equip a plastic ski with a metallic reinforcing plate extending over its entire width and a portion of its length. Tapped holes are provided in the reinforcing plate, which tapped holes are aligned with bores in the ski member and into which tapped holes fastening screws for ski bindings can be screwed.

If the reinforcing plate is thin, there exists the risk that the fastening screws are torn out. However, if it is thick, the weight of the ski is significantly increased, which is not desired. Furthermore the reinforcing plate negatively influences the elastic characteristics of the ski.

A further design of a connecting arrangement for releasably holding the binding on the ski is described in German OS 28 06 403. Inclined downwardly extending pins or tabs are arranged in this design on the underside of the two jaw members or rather on a plate fixedly connected to a jaw member, which pins or tabs extend into suitable holes or recesses in the ski. The holes can thereby be lined with slotted small tubes resiliently resting against the pins. However, it is also possible to arrange resilient parts on the pins themselves, which resilient parts prevent an unintended sliding of the pins out of the bores.

This design has the disadvantage that the pins or tabs easily bend during rough usage of the binding and can then no longer be inserted into the holes or recesses.

German OS 2 102 757 describes a plate for ski bindings having two keyhole-like recesses and one longitudinal slot. The plate can in this manner be easily placed onto a ski, especially since the screws must only be loosened, however, must not be unscrewed. However, this device is not suited for a longitudinal adjustment of the ski binding. Prior to mounting the plate, the screws project over the upper side of the ski, which is supposed to be avoided according to the invention since the screws are not tightened and therefore at times can be lost during transport.

According to German OS 2 363 562 (corresponds to U.S. Pat. No. 3,977,688), FIGS. 1 to 6, plates are mounted on the upper side of the ski, which plates project over the upper side of the ski. Receiving parts are installed into the member of the ski in the embodiments according to FIGS. 7 to 13, however, safety screws exist in all exemplary embodiments, which safety screws are supposed to prevent a rotating of the jaw or a shifting of the jaw in longitudinal direction of the ski. However, the safety screws slow down the mounting and demounting of the ski binding.

The purpose of the invention is to overcome the disadvantages of the known designs and to provide apparatus enabling a quick mounting of the ski binding on the ski and a quick removal of the ski binding from the ski.

SUMMARY OF THE INVENTION

An apparatus for releasably mounting a ski binding to the upper side of a ski by means of holding screws or the like. In order to effect a securement of the holding screws or the like into the body of the ski and without effecting the elasticity of the ski, plural anchoring mechanisms are provided in the body of the ski and are adapted to operatively cooperate with the holding screws or the like to effect a securement of the plate to the ski. The anchoring mechanisms can be of a variety of shapes adapted to cooperate with differently shaped holding screw mechanisms provided on the ski binding structure.

BRIEF DESCRIPTION OF THE DRAWINGS

Exemplary embodiments of the subject matter of the invention are illustrated in the drawings.

DETAILED DESCRIPTION

Figure 1:
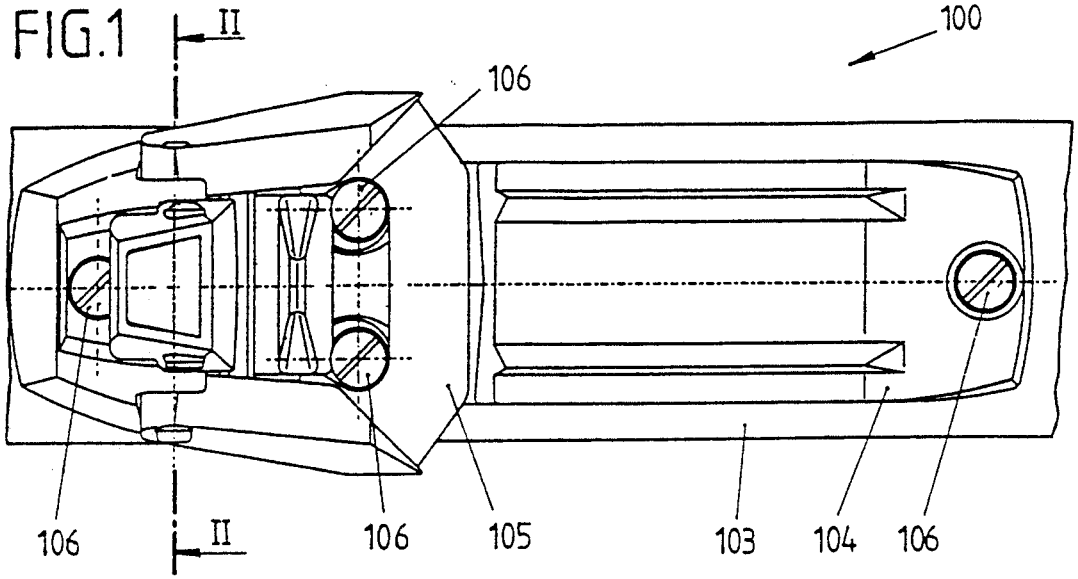
FIG. 1 is a top view of a mounted jaw member in a first embodiment.
Figure 2:
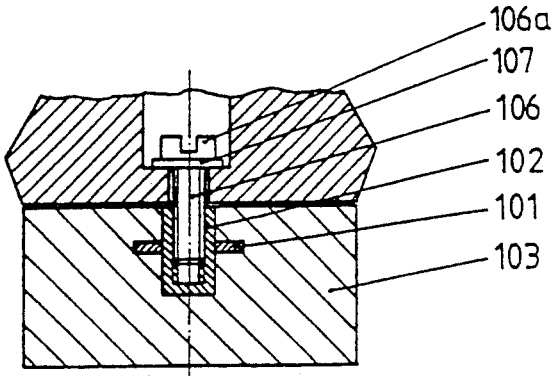
FIG. 2 is a cross-sectional view taken along the line II—II of FIG. 1.
Figure 3:
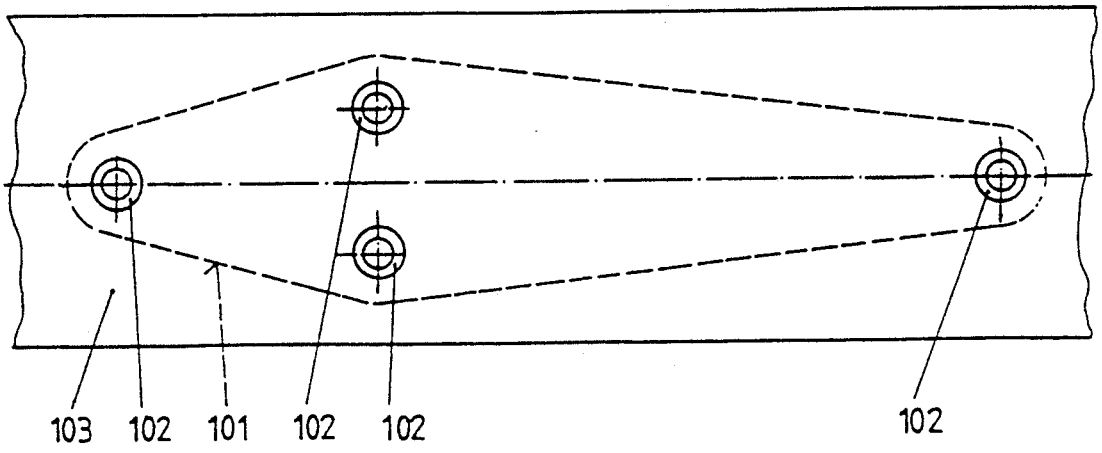
FIG. 3 is a top view of the ski with the jaw member removed.

The apparatus according to FIGS. 1 to 3 has a support plate 101 having four threaded bushings 102 forming approximately the corner points of a rhombus or rhomboid. The support plate 101 is embedded in a ski 103. Reference numeral 105 identifies a jaw member, which is constructed in one piece with a plate 104. The jaw member 105 or rather the plate 104 is fastened on the ski 103 by means of four screws 106 having a metric thread. In order to prevent the individual screws 106 from becoming loose during operation, a toothed disk or lock washer 107 exists below the head 106*a* of each screw 106.

Figure 4:
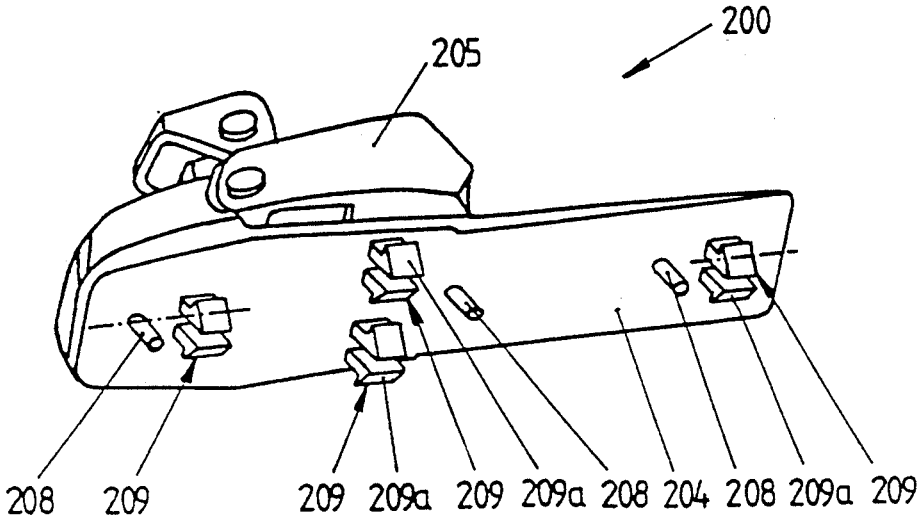
FIGS. 4 and 5 are, respectively, a perspective view of the plate from below and a top view of the ski in a second embodiment.
Figure 5:
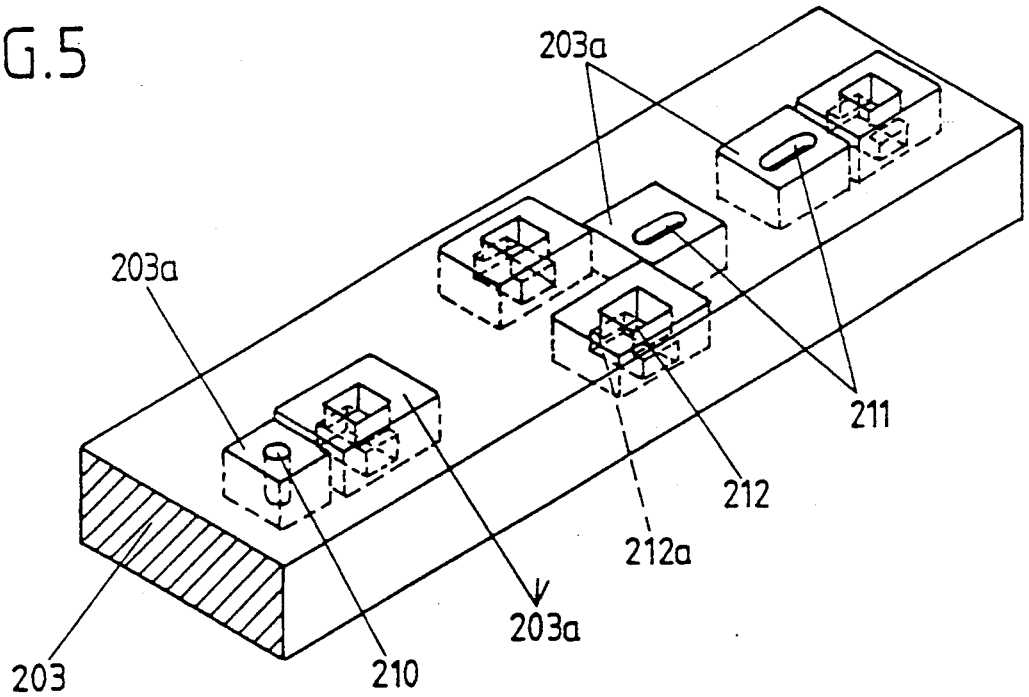
Figure 6:
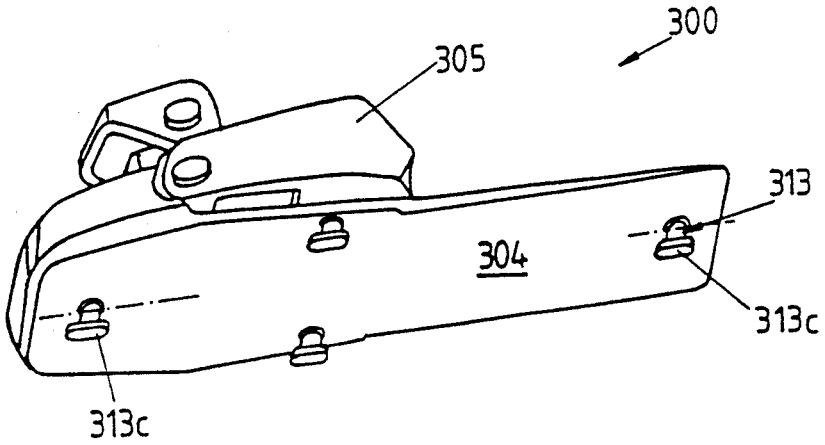
FIGS. 6 to 9 are, respectively, a perspective view of the plate from below, a top view of the ski, a cross-sectional view of the mounted jaw member and a bolt in a third embodiment.
Figure 7:
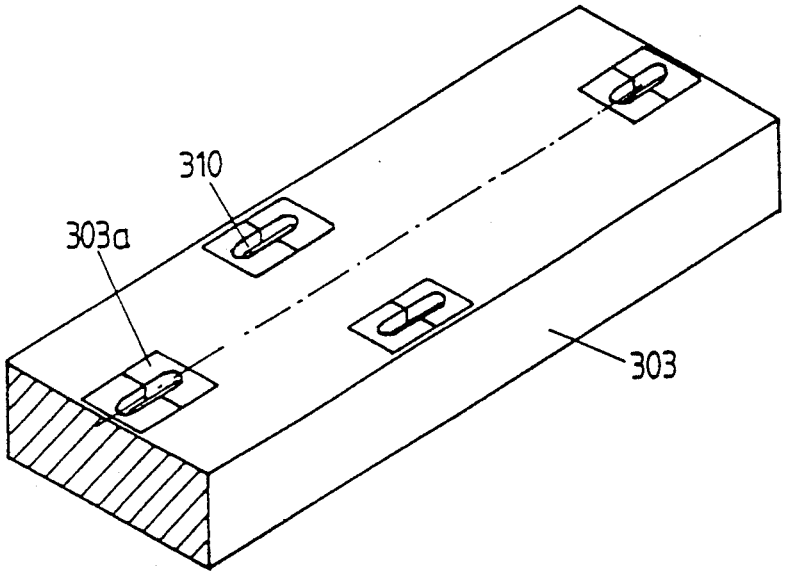
Figure 8:
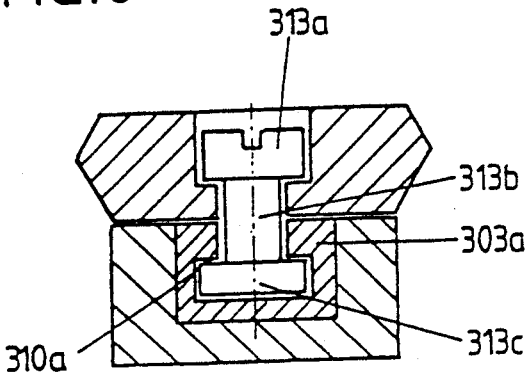
Figure 9:
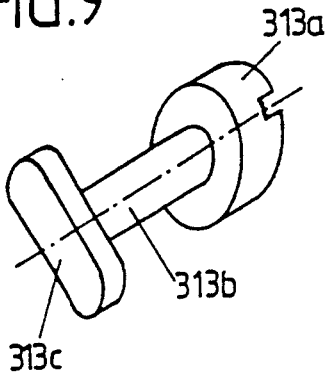

In the apparatus 200 according to FIGS. 4 and 5, the jaw member 205 is fastened on a plate 204. The plate carries three pins 208 on its underside, which pins are arranged in the vertical longitudinal center plane of the jaw member 205, namely, at the toe, in the center and at the tail end of the plate 204. Furthermore, four pairs of resilient tongues 209 are arranged on the underside of the plate 204, which tongues 209 carry hooks 209*a* at their ends. The free ends of the hooks 209*a* of each pair of tongues 209 are sloped in a roof-shaped form.

Receiving parts 203*a* exist in the ski 203, in which receiving parts 203*a* are recessed one cylindrical hole 210 and two slotted holes 211. Rectangular holes 212 are recessed in other receiving parts 203*b*, which holes 212 enlarge through a stepped portion toward the inside of the ski 203.

The jaw member 205 provided on the plate 204 is pressed against the upper side of the ski 203 during mounting. The pin 208 thereby first extends into the hole 210 and into the two slotted holes 211, and the resilient tongues 209 rest on the oppositely lying edges of the rectangular holes 212. If the contact pressure onto the plate 204 is increased, then the resilient tongues 209 of each pair are urged toward one another and the hooks 209 move inside of the holes 212. The hooks 209*a* grip thereby behind the stepped portions 212*a* of the holes 212, and the jaw member 205 is secured on the ski 203.

In the embodiment of an apparatus 300 illustrated in FIGS. 6 to 9, there are four receiving parts 303*a* arranged in the ski 303. Holes 310 elliptically shaped in the top view are recessed in the receiving parts 303*a* and have a stepped portion. Four bolts 313 exist in bores in the plate 304 of the jaw member 305. The four bolts 313 consist of a head 313*a* provided with a slot, a shank 313*b* and an elliptical small plate 313*c* attached to the shank 313*b*. The large axes of the ellipses extend in longitudinal direction of the ski. The small plate 313*c* corresponds with the cross section of one hole 310.

During mounting the plate 304 with the jaw member 305 is first placed onto the ski 303. The small plates 313*c* of the bolts 313 thereby extend through the holes 310, after which each small plate 313*c* is below the stepped portion 310*a* in the hole 310. The bolts 313 are thereafter rotated approximately 90° by means of a screw driver. The surface of the small plate 313*c* can thereby be clamped on the perforated wall below the stepped portion 310*a*.

Figure 10:
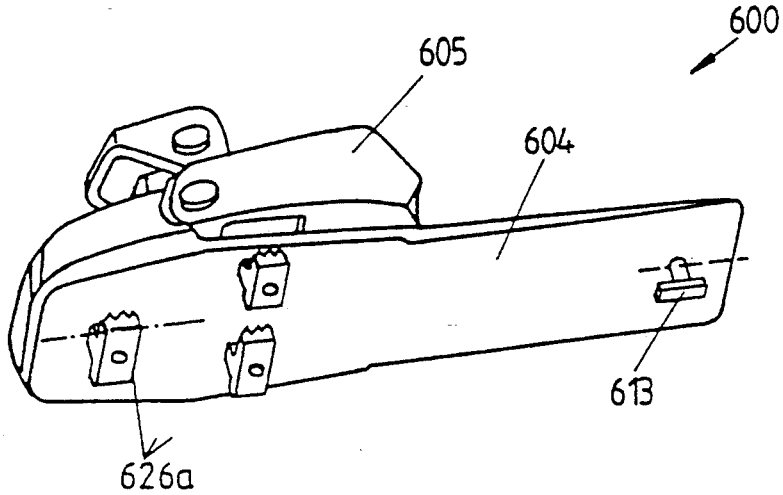
FIGS. 10 and 11 are, respectively, a perspective view of the plate from below and a top view of the ski in a fourth embodiment.
Figure 11:
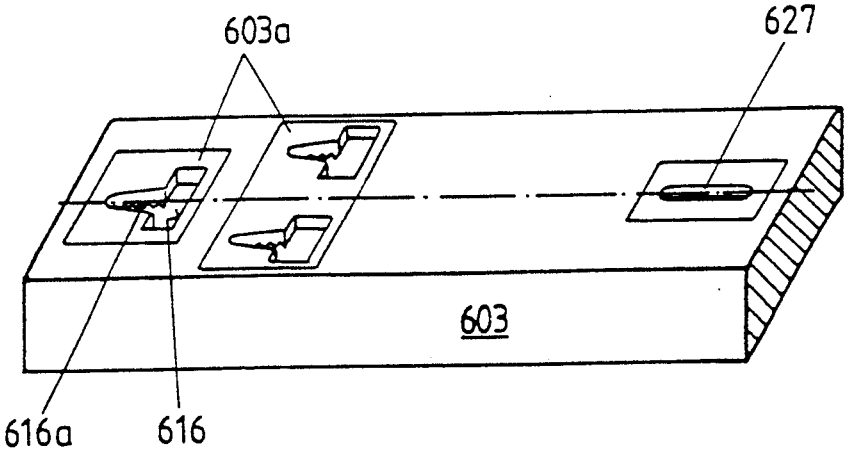

The apparatus illustrated in FIGS. 10 and 11 has screw bolts with rectangularly shaped nuts 626*a*, which latter have toothed ribs on their upper sides. T-shaped recesses 616 in the receiving parts 603*a* have on both sides of the stem of the T serrated slats 616*a* with downwardly directed teeth. A rotatably supported bolt 613 as it has already been described in connection with the apparatus 300 and which can extend into a slotted hole 627 in a receiving part 626*b* in the ski 606, which slotted hole 627 has a stepped portion, is provided at the end of the plate 604. This design enables during mounting a longitudinal adjustment of the plate 604 relative to the ski 603 corresponding with the length of the serrated slats 616*a*.

Figure 12:
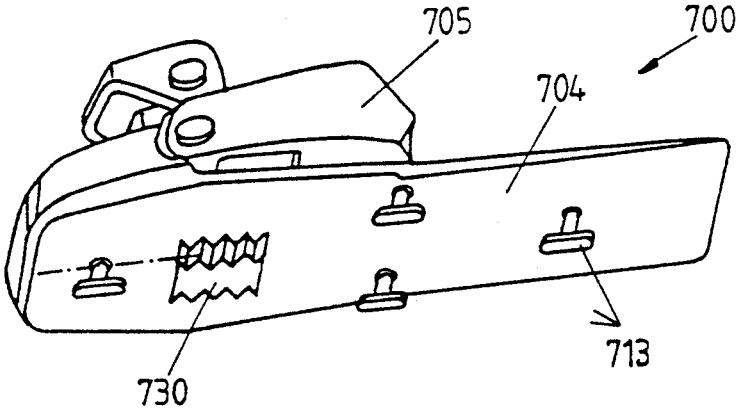
FIGS. 12 to 14 are, respectively, a perspective view of the plate from below, a top view of the ski and a detail partially in cross section in a fifth embodiment.
Figure 13:
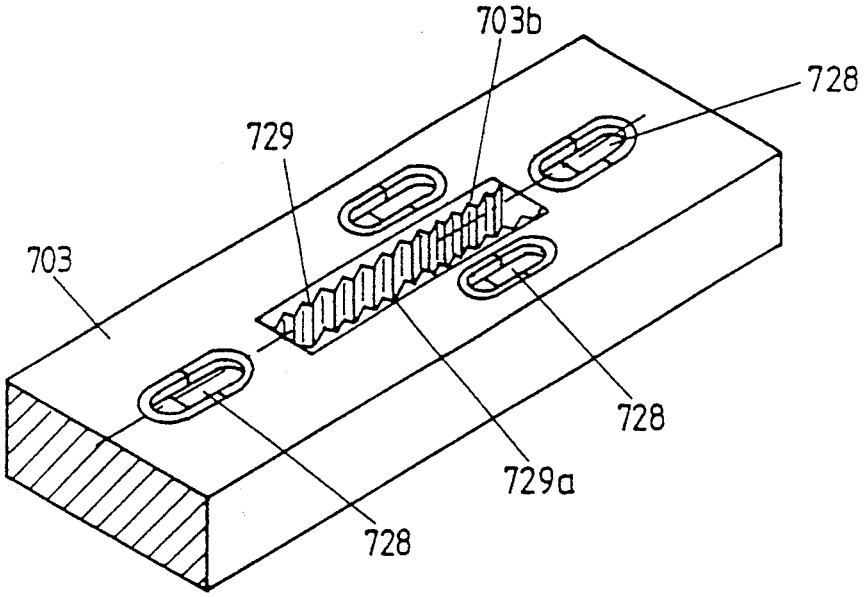

The design of an apparatus 700 according to FIGS. 12 and 13 represents a further development of the apparatus 300, which further development is distinguished by making possible a longitudinal adjustment of the plate 704 relative to the ski 703. The holes which are elliptical in the earlier design are for this purpose constructed as slotted holes 728, and a further receiving part 703*b* is provided in the ski 703, in which receiving part is arranged a recess 729*a* laterally bordered by two racks 729. A locking member 730 is associated with the recess 729*a*, which locking member is provided on the underside of the plate 704 carrying the jaw member 705. Since the racks 729 are longer than the locking member 730, a mounting of the jaw member 705 in various positions relative to the ski 703 is possible.

Figure 15:
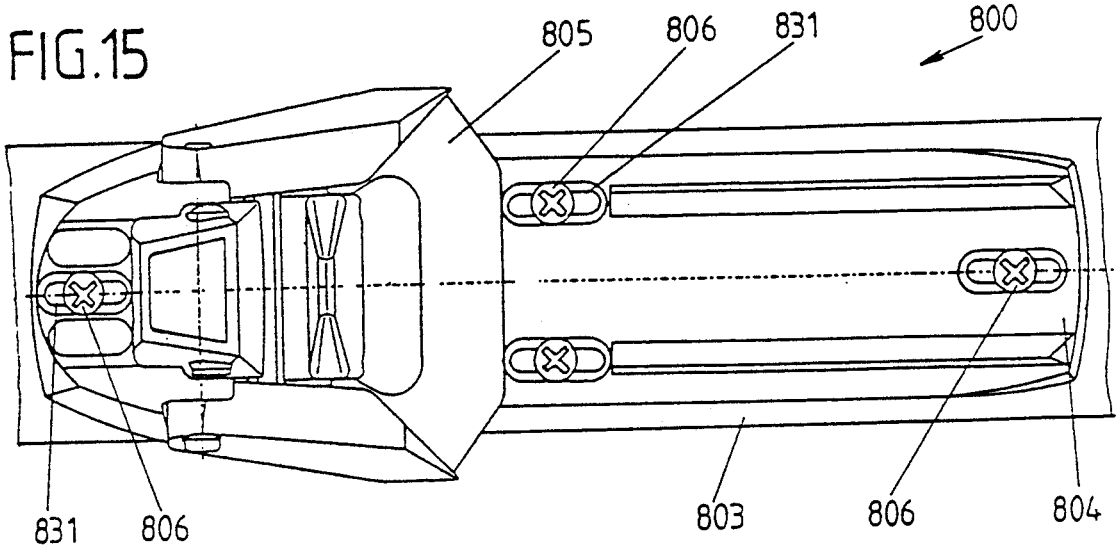
FIG. 15 is a top view of a sixth embodiment.

The apparatus 800 (see FIG. 15) differs from the aforedescribed apparatus 100 only by the screws 806 not extending through cylindrical bores and carrying the toothed disks or lock washers, but instead extend through slotted holes 831 recessed in the jaw member 805 or in the plate 804. The jaw member 805 can in this manner be adjusted in longitudinal direction of the ski relative to the ski.

Figure 16:
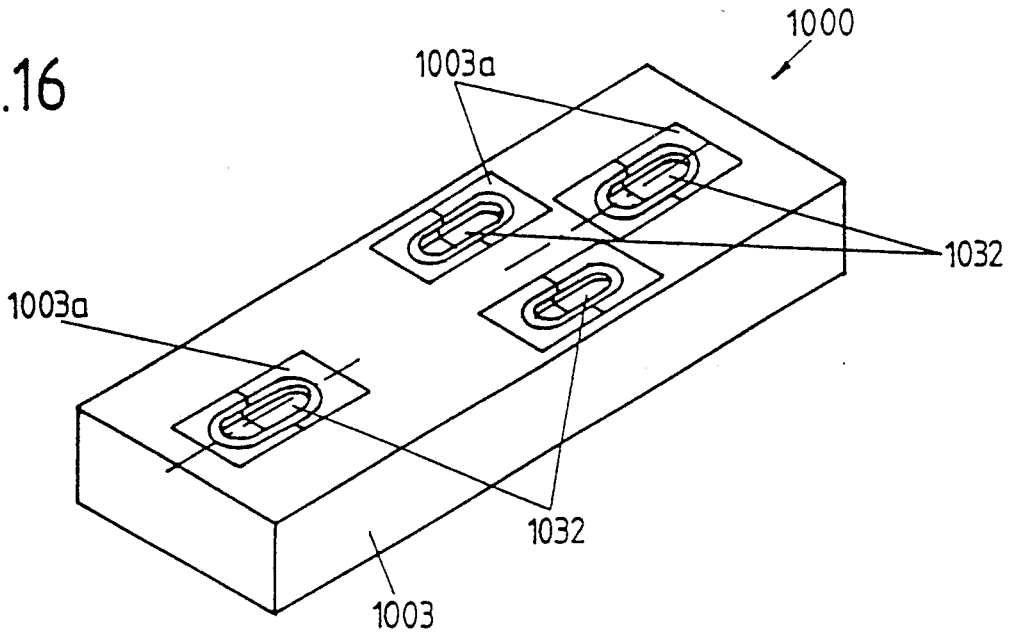
FIG. 16 shows a modification of the embodiment according to FIGS. 6 to 9.

The apparatus 1000 according to FIG. 16 illustrates a modification of the apparatus 300. The apparatus 1000 differs from the apparatus 300 only by slotted holes 1032 instead of cylindrical bores being recessed in the receiving parts 1003*a* of the ski 1003, and bolts being guided in the slotted holes, which bolts have already been described in connection with FIGS. 6 to 9.

Figure 17:
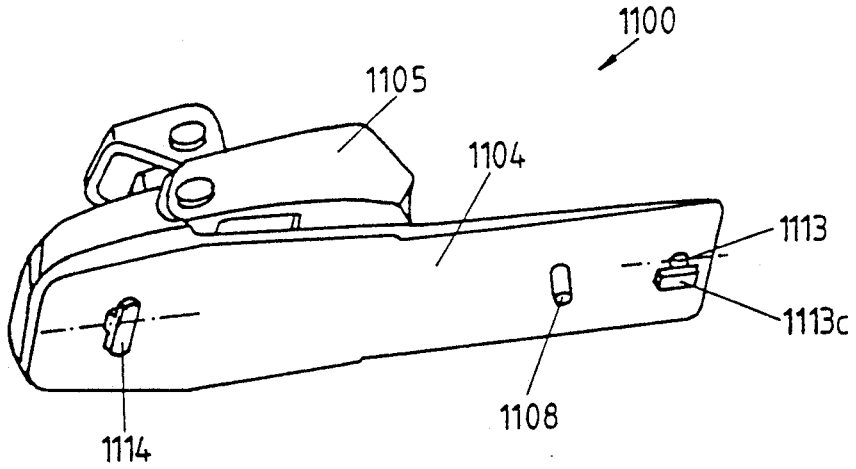
FIGS. 17 and 18 are, respectively, a perspective view of the plate from below and a top view of the ski in an eighth embodiment.
Figure 18:
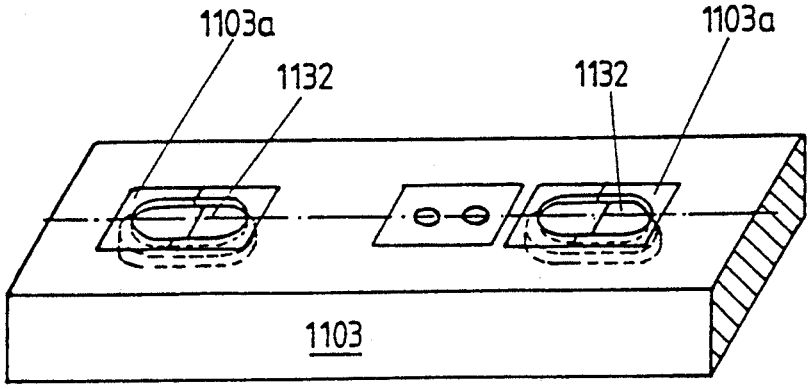

The apparatus 1100 according to FIGS. 17 and 18 is particularly simple because it has only two fastening points, namely one T-shaped projection 1114 projecting downwardly from the plate 1104 and one bolt 1113, which has a rectangular small plate 1113*c* at its end. Two slotted holes 1132 are recessed in the receiving parts 1103*a* of the ski 1103, which slotted holes have a stepped portion 1132*a*.

The plate 1104 is oriented during mounting of the apparatus 1100 rotated 90° with respect to the longitudinal axis of the ski on the ski 1103, so that the projection 1114 extends into the front slotted hole 1132. The plate 1104 is subsequently swung back 90°, so that the bolt 1113 is oriented above the rear slotted hole 1132. The rectangular small plate 1113*c* of the bolt 1113 is now introduced into the rear slotted hole 1132. The plate 1104 can now be moved along the ski 1103. As soon as the desired position of the jaw member 1105 has been reached, the bolt 1113 is rotated 90° by means of a screw driver and in this manner the plate 1104 is fixed relative to the ski 1103.

Figure 14:
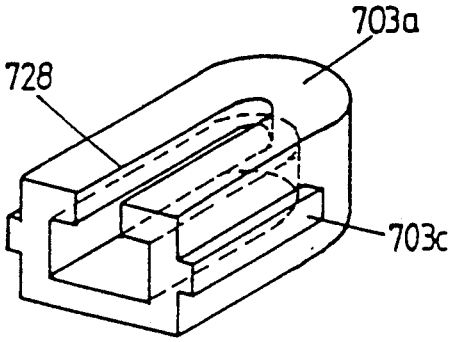
Figure 19:
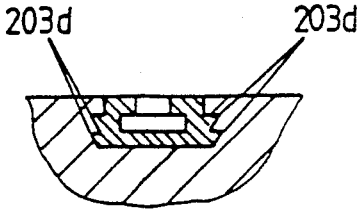
FIG. 19 is a cross-sectional view of the ski in the area of a receiving part.

Since in all embodiments the receiving parts 203*a* to 1103*a* are subjected to great stress, it is advantageous to provide each receiving part with lateral ribs. These can have a rectangular cross section, as this is illustrated with the rib 703*c* in FIG. 14. However, they can also have a saw-toothlike cross section (see FIG. 19). In this case, it is advisable to arrange two ribs 203*d* on both sides of the receiving part.

The invention is not to be limited to the exemplary embodiments above described and illustrated in the drawings. Rather, various modifications of these are possible without departing from the scope of the invention. For example, the bolts carrying an elliptical or rectangular plate at their end can possibly also be replaced by screw bolts having a rectangular nut.

We claim:

1. In an apparatus for facilitating a mounting of ski bindings onto skis, including a plate and a jaw member fastened to the plate, a centering pin on the plate, the plate being releasably fastened by a fastening means to the upper side of a ski, and wherein the fastening means include two or more fastening elements and two or more receiving parts for the ends of the fastening elements, which ends are on a side of the plate which is remote from the ski binding, the receiving parts being built into the body of the ski, the improvement wherein each receiving part includes at least one of an elliptic slotted hole and an elongated T-shaped recess, each being provided with at least one undercut step, and wherein each fastening element is arranged on at least one of the jaw member and the plate and has a locking member at an end region thereof remote from the aforesaid at least one of the jaw member and the plate, which locking member has a larger dimension in one direction compared with said at least one of the recess and the slotted hole of the individual receiving parts, and which locking member, when, viewed in the mounted state of the ski binding, engages the undercut step, wherein at least one of said fastening means is rotatable for facilitating a movement of said larger dimensioned portion of said locking member thereof between a first position aligned with a major axis of said at least one of said elliptic slotted hole and said elongated T-shaped recess extending parallel to a longitudinal axis of the ski and a second position transverse with respect to said first position and under said undercut step to thereby facilitate all of said locking members being brought into engagement with said undercut steps, and wherein said elongation of said at lest one of said hole and said recess facilitates a selective positioning of said plate and said jaw member fastened to said plate relative to the ski in a direction parallel to the major axes and before said locking members effect a locking of said plate to the ski at a said selected position, said locking members being capable of effecting said locking of said plate at any position along the length of said elongation.

2. The apparatus according to claim 1, wherein each recess is provided with an undercut step in two oppositely lying sidewalls thereof, and wherein the locking member on each fastening element includes at least one resilient tongue having an outwardly directed hook which engages the respective undercut step under the action of its own resiliency.

3. The apparatus according to claim 2, wherein the fastening elements, which have as locking members resilient tongues, are arranged in pairs side-by-side on the outside of the aforesaid at least one of the jaw member and the plate.

4. The apparatus according to claim 1, wherein each fastening element is constructed as a bolt having a head with a screw driver receiving slot therein, said head being supported in the aforesaid at least one of the jaw member and the plate, a shank being connected to said head, which shank has at its lower end as the locking member an elliptic or a rectangular small plate, and wherein each receiving part has a hole in the form of at least one of an ellipse in the top view and a slotted hole adapted to receive the locking member.

5. The apparatus according to claim 4, wherein in the ski next to the receiving parts having the slotted holes there is also arranged a further receiving part, the lateral sidewalls of the further recess each having means defining a rack, and wherein a further locking member is provided which has teeth fastened to the plate, which teeth are adapted to be inserted into the further recess and mesh with said rack.

6. The apparatus according to claim 1, wherein the undercut steps have serrated slats defining teeth directed toward the sliding surface of the ski, and wherein the fastening elements are screw bolts onto which nuts designed as locking members are screwed, which nuts are provided with teeth on their side facing the screw head, which teeth conform to the serrated slats.

7. The apparatus according to claim 1, wherein one fastening element is constructed as a projection at one end of the aforesaid at least one of the front jaw and the plate and functioning as a first locking member, which first locking member is T-shaped in the front view, a crossbar portion of which extending at a right angle with respect to the longitudinal axis of the jaw member and secured by its stem to the underside of the aforesaid at least one of the jaw member and the plate, and wherein at the other end of the aforesaid at least one of the front jaw and the plate there is rotatably supported a bolt with a rectangular small plate acting as a further locking member, both locking members acting in cooperation with slotted holes being recessed in two receiving parts in the ski, which slotted holes are each provided with a step in the oppositely lying sidewalls.

8. The apparatus according to claim 1, wherein each receiving part has on its outside at least two oppositely projecting ribs which extend in longitudinal direction of the ski and which are used to anchor the receiving parts in the ski.

* * * * *